US006340103B1

(12) United States Patent
Scheindel et al.

(10) Patent No.: US 6,340,103 B1
(45) Date of Patent: Jan. 22, 2002

(54) DISPENSING MECHANISM FOR PRESSURIZED CONTAINER

(75) Inventors: Christian T. Scheindel, Randolph Center; Dennis Dundas, East Bethel, both of VT (US)

(73) Assignee: Advanced Packaging Corp., Bethel, VT (US)

( * ) Notice: Subject to any disclaimer, the term of this patent is extended or adjusted under 35 U.S.C. 154(b) by 0 days.

(21) Appl. No.: 09/618,173

(22) Filed: Jul. 18, 2000

(51) Int. Cl.[7] ..... B65D 83/00
(52) U.S. Cl. ..... 222/402.15
(58) Field of Search ..... 222/402.1, 402.15, 222/402.25

(56) References Cited

U.S. PATENT DOCUMENTS

| | | | | |
|---|---|---|---|---|
| 2,808,806 A | | 10/1957 | Tysinger | |
| 2,914,224 A | | 11/1959 | Michel | |
| 2,957,610 A | | 10/1960 | Michel | |
| 2,965,270 A | | 12/1960 | Soffer et al. | |
| 3,066,838 A | * | 12/1962 | Hansen | 222/402.15 |
| 3,174,659 A | * | 3/1965 | Sorber et al. | 222/402.15 |
| 4,805,813 A | | 2/1989 | Metcoff et al. | |
| 4,826,054 A | * | 5/1989 | Frutin | 222/402.15 |
| 5,040,705 A | * | 8/1991 | Snell | 222/402.15 |
| 5,785,301 A | | 7/1998 | Scheindel | |

* cited by examiner

*Primary Examiner*—Joseph A. Kaufman
(74) *Attorney, Agent, or Firm*—Reed Smith LLP

(57) ABSTRACT

A dispensing mechanism for a pressurized container employs a platform which sits on and engages the valve cap. A lever pivoted on the platform extends from its pivot point up and around the nozzle to terminate in the handle that is adjacent to the sidewall of the pressurized container. The upper portion of the lever engages the shoulder on the nozzle so that when the handle is manually squeezed against the sidewall of the container, the lever pushes down on the nozzle thus pushing the nozzle and valve in a downward axially direction thereby dispensing the pressurized contents of the container. It is when the nozzle is screwed into a dispensing state that the handle or the lever is pivoted away from the sidewall of the can so that it can be squeezed against the can to effect the dispensing of the contents.

10 Claims, 4 Drawing Sheets

DISPENSING MECHANISM FOR PRESSURIZED CONTAINER

BACKGROUND OF THE INVENTION

This invention relates in general to dispensing valves for pressurized containers and more particularly to a manual actuator for use with a vertically movable valve assembly and dispensing nozzle.

Tilt action valves for pressurized containers are used to dispense a variety of products such as shaving cream, cheese products and whipped cream. Valve assemblies for such containers are described in U.S. Pat. No. 4,805,813; U.S. Pat. No. 2,965,270; U.S. Pat. No. 2,957,610; U.S. Pat. No. 2,914,224 and U.S. Pat. No. 2,808,806.

U.S. Pat. No. 5,785,301, issued on Jul. 28, 1998, describes a tilt action valve assembly. A portion of the grommet seal has a thin wall to provide a weakened area which bows to accommodate stem movement and avoid displacement of the lower portion of the grommet seal. The result is a valve stem which not only tilts but can also move downward in the can along the axis of the stem. This improves sealing and also enhances communication between the contents of the can and the flow orifices at the base of the stem.

This enhanced communication between the interior of the can, where the material to be dispensed is held, and the flow orifices for the stem is particularly important where viscous products such as caulk and urethane sealant are to be dispensed.

It is desirable that a dispensing valve and discharge nozzle be movable in an axial direction rather than tilted in order to increase this communication and facilitate dispensing of the material involved.

In addition, an axially movable valve can be more readily sealed to assure against leakage of the contents of the can.

It is important, for most practical applications, such as consumer usage in dispensing caulk, that the valve be readily movable by hand. One of the reasons that tilt valves are so frequently used is because it is easy for the user to force the valve over into a tilted position through movement with a single hand.

Accordingly, it is a major purpose of this invention to provide a manually actuated vertically movable dispensing valve arrangement in which the user through the application of actuating pressure by the user's hands can dispense material in the pressurized can.

It is a closely related purpose of this invention to provide such hand actuation with an actuator device that can readily be moved through force applied by a single hand of the user.

It is a further purpose of this invention to provide an axially actuated single hand dispensing valve arrangement in which the cost of the improved feature is relatively small so that it an be used or incorporated without substantially increasing the cost of the dispensing container. This last feature is important in order for the cost of the improvement to be comparable to the valve of the increased facility in dispensing materials involved.

It is a particular purpose of this invention to provide this enhanced actuating feature for an axially movable valve in the context of dispensing materials that are relatively thick and viscous such as caulk and urethane sealant.

BRIEF DESCRIPTION

The hand operated dispensing device includes a platform which is mounted onto the cap of a typical pressurized container for dispensing such items as urethane seal or caulk. A front part of the platform has openings into which a lever is pivotally mounted. The lever extends up from the platform and back with an upper portion having an opening to accommodate the nozzle. The lever thus extends around the nozzle into a handle that extends down along the side of the pressurized container. The nozzle has a shoulder against which the upper portion of the lever normally rests. When the nozzle is screwed up into the dispensing state, the handle of the lever rotates up into position where it extends at an angle away from the sidewall of the pressurized can. The user squeezes the handle with one hand thereby causing the upper portion of the pivotally mounted lever to bear down on the shoulder of the nozzle pushing the nozzle axially downward thereby pushing the valve, to which the nozzle is mounted, axially down and thus causing the valve openings to be exposed to the material in the can. Accordingly, the material in the can is dispensed through the valve and nozzle.

The platform of this actuating device has a rigid forwarding engaging lip which engages approximately 120° of the valve cap. A small flexible rearward engaging lip also engages the valve cap. This permits ready assembly of the platform and thus the lever on a pressurized container. It also permits removing this actuating device for use on multiple cans.

BRIEF DESCRIPTION OF THE DRAWINGS

In FIG. 1 the dispensing nozzle is screwed down on the valve stem into the shut state so that the contents cannot be dispensed.

DESCRIPTION OF THE PREFERRED EMBODIMENTS

Figure 3:
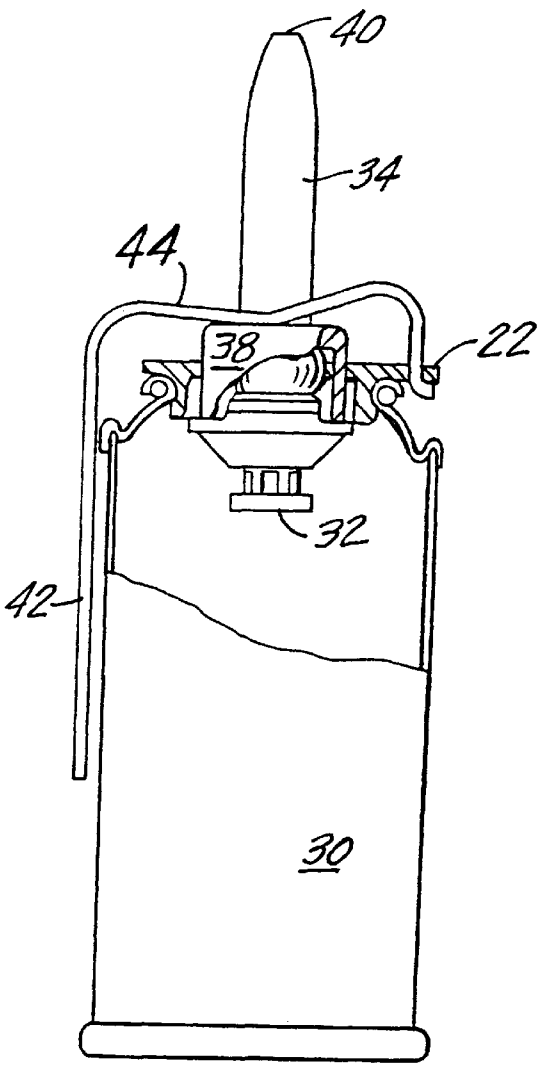
FIG. 3 is a view of the FIG. 2 dispensing state with the actuator handle pressed into the position where the contents are dispensed.

FIGS. 1 through 10 illustrate a first embodiment which employs the wire-formed lever/handle 20. This lever 20 is mounted at its front end on a platform 22 so that the lever can rotate or pivot about the pivot zone 24 near its front end. The platform 22 is mounted on the cap 26 of the dispensing valve.

More generally, the dispensing container 28 has a body 30 and a dispensing valve 32. The dispensing valve 32 has a cap 26, which cap 26 provides a lip onto which the platform 22 of the actuator of this invention is mounted. A dispensing nozzle 34 is screwed onto the screw threads 36 of the value stem.

Figure 1:
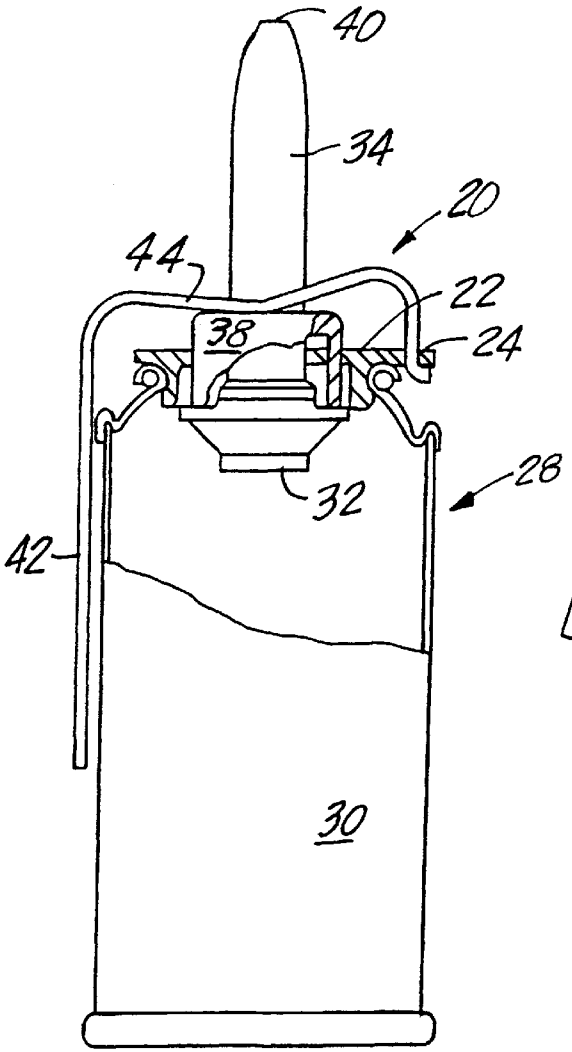
FIG. 1 is an illustration of a first embodiment of the dispensing actuator of this invention mounted on a pressurized can.
Figure 7:
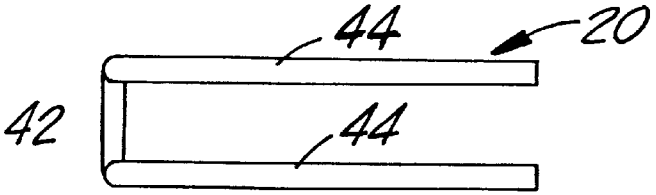
FIG. 7 is a top view the FIG. 4 lever.
Figure 4:
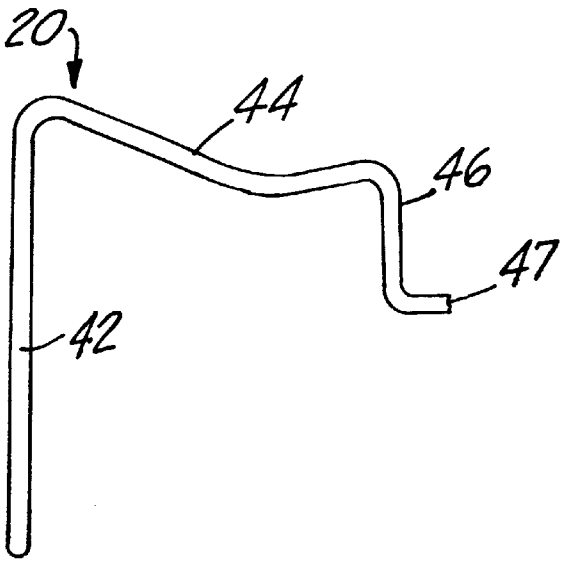
FIG. 4 is a side view of the lever component of the actuator of this invention. This is the actuator lever shown in FIG. 1.
Figure 5:
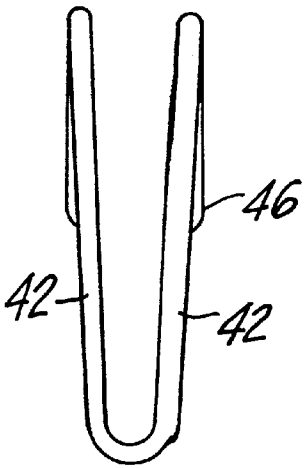
FIG. 5. is a left side view of the FIG. 4 lever.
Figure 6:
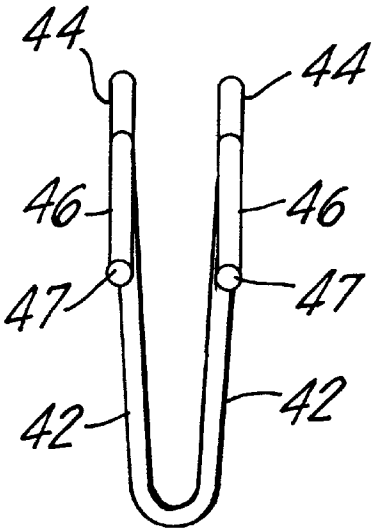
FIG. 6 is a right view of the FIG. 4 lever.

In FIG. 1, the dispensing nozzle 34 is screwed down on the value stem to the point where the upside down cup shaped shoulder 38 bottoms out on the cap 26. In this FIG. 1 closed state, the nozzle 34 and associated valve stem 36 can not either tilt or be moved down so that the can is in its closed state and the contents, which are under pressure, cannot be dispensed. The shoulder 38, which operates as a stop when it bottoms out on the cap 26, is part of the nozzle 34 and thus the shoulder 38 and nozzle 34 move axially as a unit.

Figure 2:
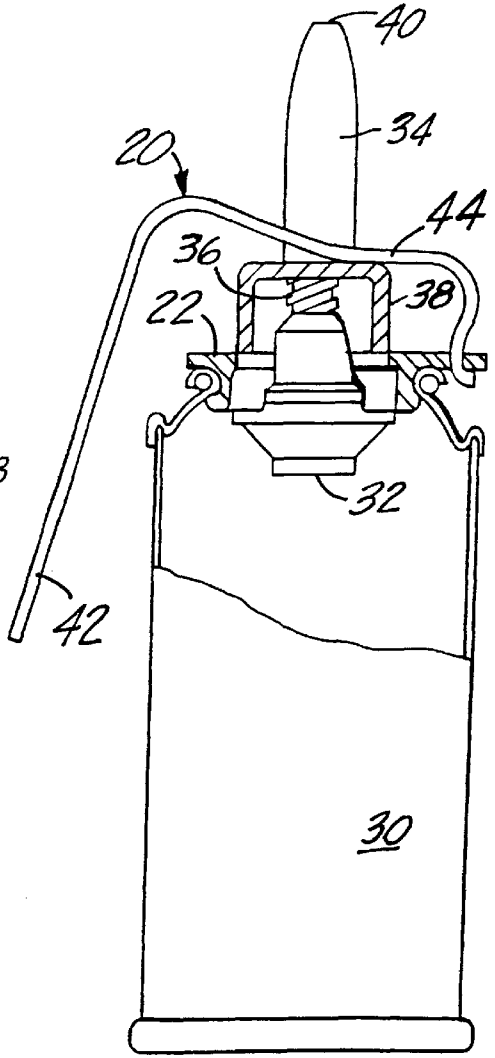
FIG. 2 is a view similar to that of FIG. 1 with the dispensing nozzle screwed up into the dispensing state with the actuator positioned so that the handle can be pressed to cause the contents of the can to be dispensed.

In order to dispense contents, the nozzle 34 has to be screwed up into the state shown in FIG. 2. In that state, the cup-shaped shoulder 38, which is attached to the nozzle 34, is in a position to move down. When this shoulder 38 is moved down by the lever 12 to the state shown in FIG. 3, the valve ports 39 are exposed to the pressured contents of the can 28 and the contents will be forced up through the valve stem and nozzle to be dispensed through an opening 40 at the upper tip of the nozzle 34.

In use, the procedure followed is for the can 30 to be shipped in the FIG. 1 closed state. When product is to be dispensed, the user unscrews the nozzle 34 into the FIG. 2 state and then the user's hands are wrapped around the handle 42 and the body 30 of the can and by a squeezing action forces the nozzle 34 and valve down into the dispensing state shown in FIG. 3.

FIGS. 4 through 7 illustrate the wire formed lever 20 used is this embodiment of this invention. The lever 20 is formed from a one-eighth inch diameter steel wire and has a handle portion 42, a top force transmitting portion 44 and a front portion 46 that terminates in an L-shaped end that provides two pegs 47 which fit into openings 48 in the platform 22. The two wire sides of the top portion 44 are spaced far enough apart so they do not bind on the nozzle 34, but are close enough together that they abut against the upper surface of the shoulder 38.

Thus, the actuating lever 20 has a handle portion, an intermediate force transmitting portion and a pivoting end. The pivoting end is mounted on the openings 48 of the platform 22. The force transmitting portion rests against the upper surface of the shoulder 38. When the valve is in its closed state (FIG. 1), the force transmitting portion 44 essentially rests against this shoulder 38.

When the valve is open and product is to be dispensed (FIG. 2), the user grips the can and handle 42, applies pressure and brings the handle into the state shown in FIG. 3. This causes the force transmitting portion 44 to bear down on the top of the shoulder 38, thereby forcing the valve in an axially downward direction so that the openings 39 at the lower end of the valve stem are in full communication with the contents of the can and the contents of the can are dispensed.

The platform 22 which is shown in FIGS. 8 through 11 has the two opening 48 into which the front ends 46 of the lever 20 are mounted. The platform 22 has a plate portion 50 that has a central opening 52 large enough to permit the walls of the cup-shaped shoulder 38 to pass through this opening 52. The platform 22 has engaging lips 54, 56 which extend below the platform and which are designed to engage the cap 26 of the dispensing valve is best be seen in FIG. 11. A front rigid engaging lip 54 extends a substantial portion of the way around the periphery of the opening 52. It extends preferably 120°, but less than 180°, around the periphery. This engaging lip 54 prevents the platform 52 from lifting out of position when pressure is applied to the handle 42. Such pressure causes pivoting of lever 20 in the openings 48 that tend to pull the platform up.

A small flexible plastic engaging lip 56 at the rear of the platform also engages the cap 26 to hold the platform in place. In operation the forces tending to lift the platform 22 will be on the forward section of the platform and not on the rear section of the platform. Thus the lip 56 need only be large enough to position the platform.

Figure 9:
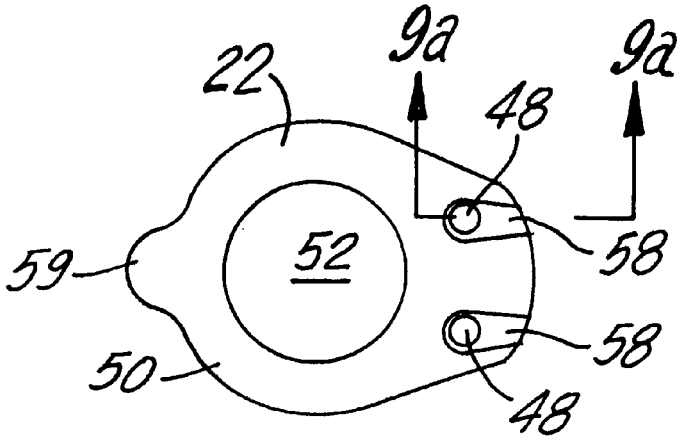
FIG. 9 is a top view of the FIG. 8 platform.
Figure 9A:
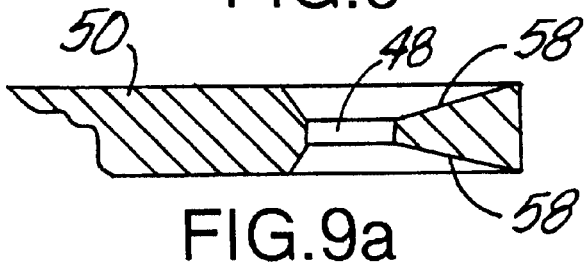
FIG. 9*a* is a sectional view along the plane A—A of the necked down opening in the platform that provides the fulcrum on which the lever pivots.
Figure 8:
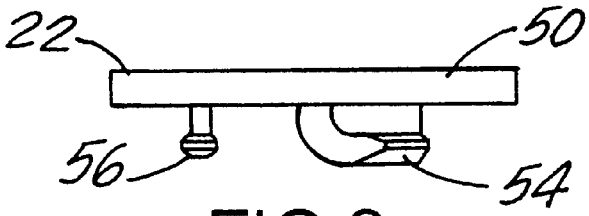
FIG. 8 is a side view of the platform component of the actuator of this invention. This is the platform to which the lever of FIG. 4 is pivotally mounted.
Figure 10:
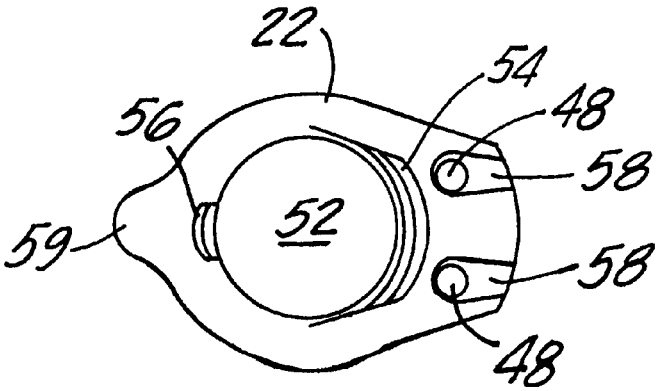
FIG. 10 is a bottom view of the FIG. 8 platform.

As shown in FIG. 9 and 9*a*, the openings 48 are formed in a necked down section of the plate 50. This neck down section 58 is useful to facilitate inserting the forward end 46 of the lever 20 into the openings 48. It also prevents binding during pivoting of the forward end of the lever in the openings 48. By providing a relatively thin fulcrum, this binding is avoided.

Figure 11:
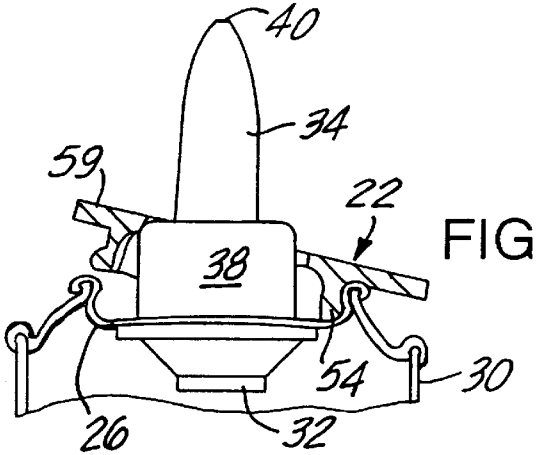
FIG. 11 illustrates the assembly of the FIG. 8 platform into engagement with the valve cap.

As shown in FIG. 11, the platform 22 is assembled by first inserting the larger rigid lip 54 into engagement with the cap 26 and then snapping the flexible plastic smaller lip 56 into place. A small top 59 on the platform facilitates manual assembly and also disassembly of the platform 22 and lever 20. Thus the dispensing device of this invention can be reused on multiple pressurized containers.

Figure 14:
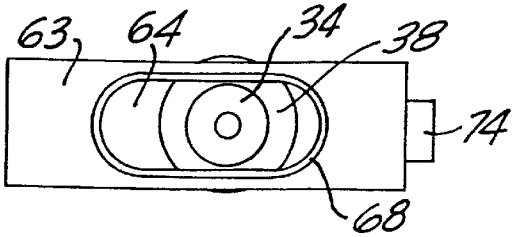
FIG. 14 is a top view of the lever used in the FIG. 12 embodiment.
Figure 12:
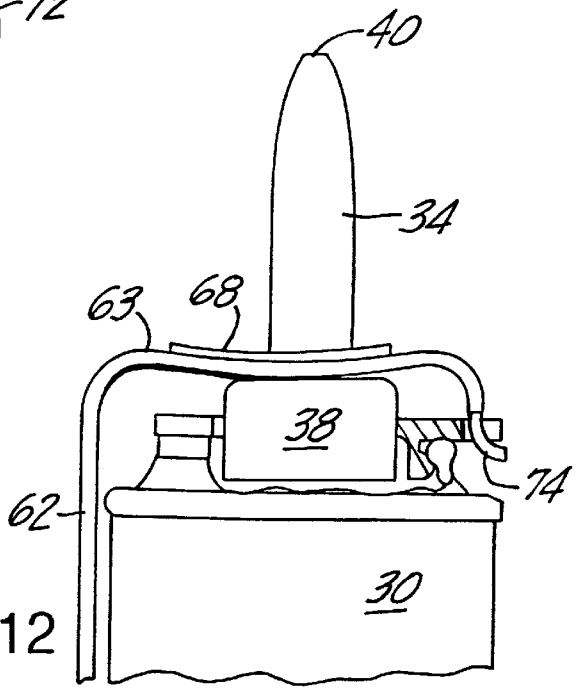
FIG. 12 is a elevation view of a second embodiment of the dispensing actuator of this invention in which the lever is formed from a flat sheet of metal rather than from a wire.
Figure 15:
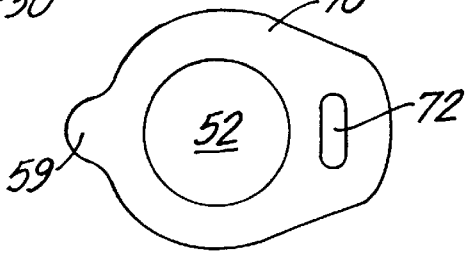
FIG. 15 is a top view of the platform employed in the FIG. 12 embodiment.
Figure 13:
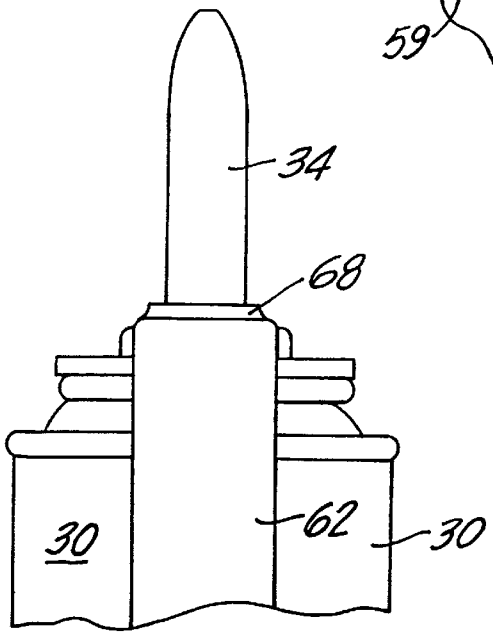
FIG. 13 is a left side view of FIG. 12 showing the flat plate handle portion of the lever.

FIGS. 12 through 14 illustrate a second embodiment of this invention in which a flat plate lever 60 is employed. The handle 62 thus has no opening. However, at the top of the lever 60, an opening 64 is formed therein to accommodate the nozzle 34. A small boss 68 around the opening 64 serves to reinforce the upper portion 63 of the lever 60. The platform 70 in the second embodiment is similar to the platform 22 of the first embodiment. In particular the platform 70 has the same type of lips 54 and 56 used to engage the platform with the valve cap 26. One difference is that the front opening 72 is a single opening that is sized to pivotally engage a cut-down forward segment 74 of the lever 60.

As it will be apparent to those skilled in this art, variations may be made on the embodiments disclosed and yet remain within the scope of the invention herein.

For example, the cup shaped shoulder 38 on the nozzle 34 could be a shoulder without the sidewalls since the nozzle and valve will normally be limited to their excursion by the handle abutting against the sidewall of the container.

What is claimed is:

1. A dispensing mechanism for a pressurized container having a sidewall, an axially movable valve, a valve cap and a dispensing nozzle, comprising:

a platform adapted to be removably fitted on the valve cap, a lever, said platform having a front portion, said lever having a front end pivotally mounted to said front portion of said platform, said lever having an intermediate force transmitting portion adapted to engage the nozzle, said lever having a rear handle portion, actuation of said handle portion causing said intermediate portion to force the nozzle and the valve on which the nozzle is positioned into a position to cause product to be dispensed from the container, said platform having a first relatively rigid engaging lip extending below said platform at said front portion of said platform to engage the valve cap, said first lip subtending an arc sufficiently great to provide substantial engagement between said first lip and the valve cap and to resist forces tending to lift said platform from the valve cap when forces are exerted at the pivotal engagement between the front end of said lever and said front end of said platform, said platform having a second engaging lip spaced from said first engaging lip to stabilize said platform on said cap, said second engaging lip being flexible and covering an arc substantially less than the arc of said first engaging lip in order to permit said platform to be readily placed on and removed from the cap.

2. The dispensing mechanism of claim 1 wherein said first engaging lip subtends an arc of approximately 120°.

3. The dispensing mechanism of claim 2 wherein the nozzle has a peripheral shoulder and said intermediate force transmitting portion of said lever has an opening greater than the diameter of the nozzle and less than the diameter of the peripheral flange so that said intermediate force transmitting portion abuts on the nozzle shoulder.

4. The dispensing mechanism of claim 1 wherein said platform contains at least one opening in said front portion thereof, said front end of said lever being pivotally mounted in said platform opening.

5. The dispensing mechanism of claim 4 wherein said front portion of said platform has a reduced thickness zone at said opening to provide a non-binding pivotal engagement between said front end of said lever and said platform.

6. The dispensing mechanism of claim 5 wherein said first engaging lip subtends an arc of approximately 120°.

7. The dispensing mechanism of claim 4 wherein said first engaging lip subtends an arc of approximately 120°.

8. The dispensing mechanism of claim 4 wherein the nozzle has a peripheral shoulder and said intermediate force transmitting portion of said lever has an opening greater than the diameter of the nozzle and less than the diameter of the peripheral flange so that said intermediate force transmitting portion abuts on the nozzle shoulder.

9. The dispensing mechanism of claim 1 wherein the nozzle has a peripheral shoulder and said intermediate force transmitting portion of said lever has an opening greater than the diameter of the nozzle and less than the diameter of the peripheral flange so that said intermediate force transmitting portion abuts on the nozzle shoulder.

10. The dispensing mechanism of claim 9 wherein said first engaging lip subtends an arc of approximately 120°.

* * * * *

UNITED STATES PATENT AND TRADEMARK OFFICE

CERTIFICATE OF CORRECTION

PATENT NO. : 6,340,103
DATED : January 22, 2002
INVENTOR(S) : Christian T. Scheindel and Dennis Dundas It is certified that error appears in the above-identified patent and that said Letters Patent is hereby corrected as shown below:

Column 3,
Line 14, change "value" to -- valve --.
Line 17, change "value" to -- valve --.

Signed and Sealed this

Twenty-first Day of May, 2002

*Attest:*

*Attesting Officer*

JAMES E. ROGAN
*Director of the United States Patent and Trademark Office*